US005456477A

United States Patent [19]

Bourdeau

[11] Patent Number: 5,456,477

[45] Date of Patent: Oct. 10, 1995

[54] SKATE WITH IN-LINE WHEELS INCLUDING AN ARRANGEMENT FOR SEALING THE BEARINGS THEREOF

[75] Inventor: Joël Bourdeau, Saint-Jorioz, France

[73] Assignee: Salomon S.A., Metz-Tessy, France

[21] Appl. No.: 70,167

[22] Filed: Jun. 2, 1993

[30] Foreign Application Priority Data

Jun. 9, 1992 [FR] France ..... 92 07146

[51] Int. Cl.[6] ..... A63C 17/06; A63C 17/22

[52] U.S. Cl. ..... 280/11.22; 301/5.7; 301/37.22

[58] Field of Search ..... 280/11.19, 11.22, 280/11.23, 11.27; 301/5.3, 5.7, 37.22

[56] References Cited

U.S. PATENT DOCUMENTS

| | | | |
|---|---|---|---|
| 988,533 | 4/1911 | Zverina | 301/5.7 X |
| 1,900,040 | 3/1933 | Brien | 301/5.7 X |
| 1,975,905 | 10/1934 | Specht | 280/11.22 |
| 2,034,948 | 3/1936 | Knapp . | |
| 2,073,708 | 3/1937 | Parrish | 301/5.7 |
| 2,963,326 | 12/1960 | Wood | 301/37.22 |
| 3,089,731 | 5/1963 | Barnes | 301/37.22 |
| 3,389,922 | 6/1968 | Eastin | 280/11.23 |
| 3,823,952 | 7/1974 | Kukulowicz | 280/11.2 |
| 4,408,803 | 10/1983 | Green et al. | 301/5.7 |
| 5,308,152 | 5/1994 | Ho | 301/5.3 |

FOREIGN PATENT DOCUMENTS

| | | |
|---|---|---|
| 967995 | 5/1975 | Canada . |
| 982142 | 6/1951 | France . |

*Primary Examiner*—Brian L. Johnson

*Attorney, Agent, or Firm*—Sandler, Greenblum & Bernstein

[57] ABSTRACT

A skate of the type with in-line wheels including a chassis formed by an upper horizontal plate which is solidly attached to the sole of a shoe by fasteners and by a lower part which runs perpendicular to the plate along its longitudinal axis and which includes two lateral flanges forming fork joints, between which the wheels are located on transverse axles, constituting a rolling train, each of the wheels having at least one bearing on which rests an elastic envelope of which the central part is composed of a tire which extends laterally into two flanks, wherein included is an arrangement for sealing the bearing, provided in the area of the envelope, between the envelope and a fixed part which is adjacent to it.

5 Claims, 3 Drawing Sheets

SKATE WITH IN-LINE WHEELS INCLUDING AN ARRANGEMENT FOR SEALING THE BEARINGS THEREOF

BACKGROUND OF THE INVENTION

1. Field of the Invention

The present invention concerns a skate with in-line wheels, the usage of which is related to the technique of ice skating.

2. Discussion of Background and Relevant Information

The aforementioned type of skate is intended for training ice skaters outside the skating rink, as well as for all athletic people desiring to maintain or perfect the techniques used in gliding sports such as downhill skiing, cross-country skiing, ice skating, etc., on a hard surface of asphalt, cement, etc.

Just as in those sports, the practice of this sport consists of a motive or propulsive phase in which the skate is pushed toward the outside and the consequently inclining wheels are leaned upon, analogously to digging in the edges of an ice skate blade, then a gliding phase, executed by repositioning the wheels perpendicular to the ground.

In this same technique of skating on in-line wheels, braking is accomplished by lateral drag of the inclined wheels or conversely by opposition.

Turns are also executed by leaning laterally on the wheels.

The wheels used at this time for in-line roller skates consist generally of at least one bearing intended to be made solid with an axle and on which is mounted an elastic envelope, the central part of which consists of a tire which is extended laterally into two flanks.

It is easily understood that the proper functioning of these skates as well as their longevity depends on the quality of these bearings.

Now this quality, however good it may be, is directly influenced by the particular conditions of use of the skates which are particularly exposed to splashes of water, to dusty environments, and generally to all sorts of soiling coming from the surfaces they move on.

To overcome this drawback, a well-known technique consists of using sealed bearings, which are widely distributed in the trade but which have the major inconvenience of a cost that is 1.5 to 2 times higher than that of a non-sealed wheel of equivalent quality.

SUMMARY OF THE INVENTION

An object of the present invention is to overcome the aforementioned problem by proposing a simple and economic solution for the fabrication of sealed wheels.

To this end, the invention concerns a roller skate, in particular the type of skate with in-line wheels, including a chassis, formed by an upper plate supporting the sole of a shoe, and a lower part, perpendicular to the plate and extending along its longitudinal axis, consisting of two lateral flanges forming fork joints, between which are disposed the wheels by means of transverse axles, forming a rolling train, each of the wheels comprising at least a bearing on which is mounted an elastic envelope composed of a tire extending laterally into two flanks, wherein it includes sealing means of the bearing provided at the level of the elastic envelope, between the envelope and a fixed part which is adjacent to it.

BRIEF DESCRIPTION OF THE DRAWINGS

The invention will be better understood, and other characteristics thereof will become apparent with the aid of the ensuing description, in conjunction with the appended schematic drawings, illustrating by a non-limiting example how the invention can be accomplished.

DETAILED DESCRIPTION OF THE PREFERRED EMBODIMENTS

Figure 2:
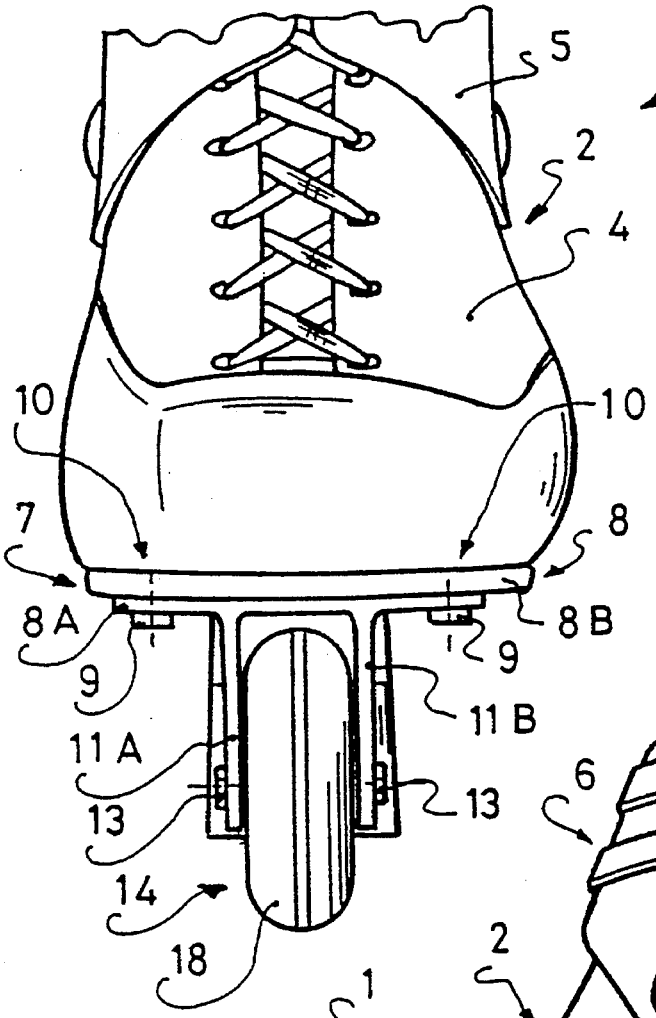
FIG. 2 is a front view of a skate in accordance with FIG. 1.
Figure 1:
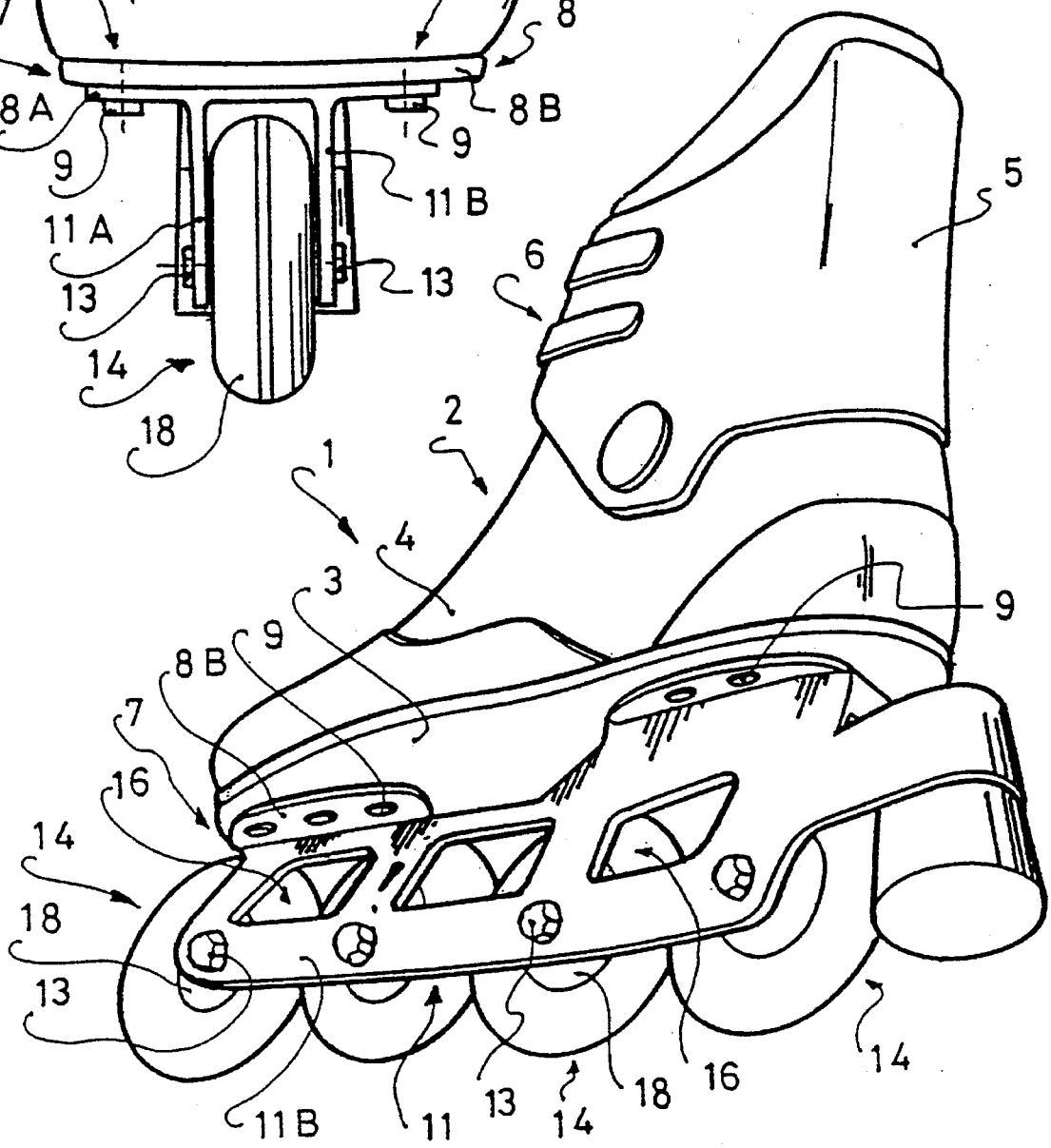
FIG. 1 is a view in perspective of an in-line roller skate and its attached shoe.

The in-line roller skate designated in its entirety by reference numeral 1 and represented in FIGS. 1 and 2 includes a shoe 2 composed of a sole 3 surmounted by a lower shank part 4 extending into an upper shank part 5 through the open end of which the skater's foot is introduced. The shank part 5 includes fasteners 6.

Since such a shoe is known in the art, it has not been described in further detail here.

The sole 3 of the shoe 2 is solidly joined to a chassis 7 formed by an upper horizontal plate 8 in two parts, to which the sole 3 is fixed by fasteners, in this case screws 9 passing through the plate 8 in order to screw into the lateral edges 10 of the sole 3.

The chassis 7 also includes a lower part 11 perpendicular to the plate 8 along its longitudinal axis.

This lower part includes two lateral vertical flanges 11A, 11B parallel to one another and disposed along either side of the longitudinal axis.

The lateral flanges 11A and 11b each extend at their upper ends into a perpendicular return 8A and 8B, each one pointing toward the outside, and constituting a plane corresponding to the horizontal plate 8.

In this manner the vertical flanges 11A and 11B, along with the sole 3 of the shoe 2, generally define an inverted U between whose flanges transverse axles 13 are fixed, to which wheels 14 are mounted, here four in number, are disposed in the longitudinal axis to constitute a rolling train.

Openings 16 have as their essential purpose lightening the structure of the chassis 7 described above.

Figure 3:
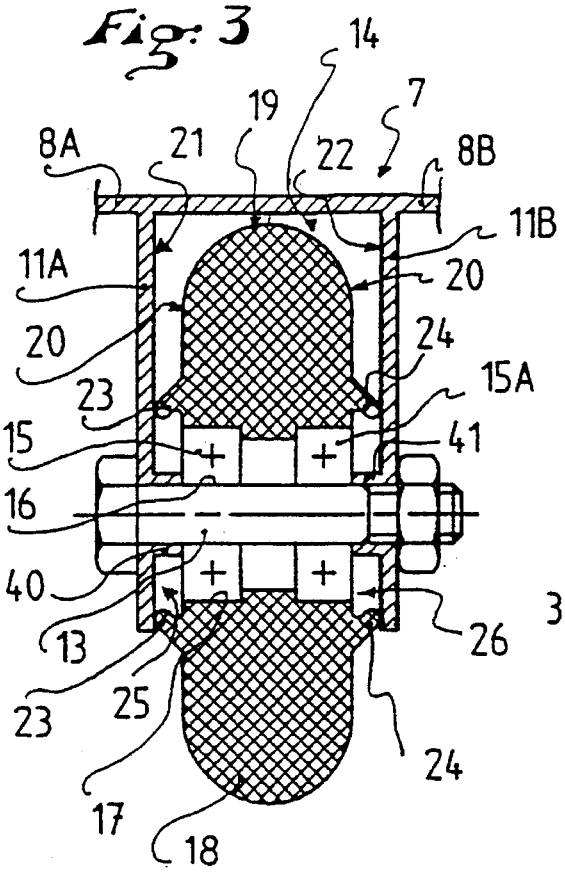
FIG. 3 is a view in diametric section of a skate wheel, in large scale, according to a first embodiment of the invention.

According to a first exemplary embodiment represented in FIG. 3, the wheel 14 includes two ball bearings 15, 15A, each of these being formed, in a manner known per se, by an internal race 16 solidly joined to the transverse axle 13; turning on this race 16, by means of the balls (not shown in the drawing), is an outer concentric ring 17 to which an elastic envelope 18 is attached.

This envelope 18 includes a central tire or running tread 19, extended laterally by two flanks 20.

According to the invention, the wheel 14 includes sealing means 23, 24 of the ball bearings 15, 15A, located in the area of the envelope 18, between the envelope and a fixed part which is adjacent to it.

In this case, these sealing means 23, 24 of the bearings 15, 15A are respectively inserted on each side of the wheel 14, between the inner surface 21 or 22 of the fork joints 11A or 11B composed of fixed parts, and the flanks 20 of the envelope 18 which are located facing these inner surfaces.

In the present case shown, the sealing means 23, 24 of the bearings 15, 15A consist of elastically deformable annular lips 23, 24 which are made of the same material as that constituting the flanks 20 of the envelope 18 and which rests on and which are engageable with the inner surfaces 21 or 22 of the fork joints 11A or 11B.

Thus, a closed sealed chamber 25 or 26 is defined between the flanks 20 of the envelope 18 and the fork joints 11A and 11B, around each of the ball bearings 15, 15A.

Preferably, in order to avoid excessive crushing of the lips 23, 24, the fork joints 11A, 11B have protrusions 40, 41 which are concentric to the axle 13, with a height lower than that of the lips when they are not compressed. Moreover, the lips 23, 24 are oriented on an angle toward the axle 13, i.e., the lips 23, 24 are oriented at a non-perpendicular angle with respect to the inner surfaces of the lateral flanges 11A, 11B.

Figure 4:
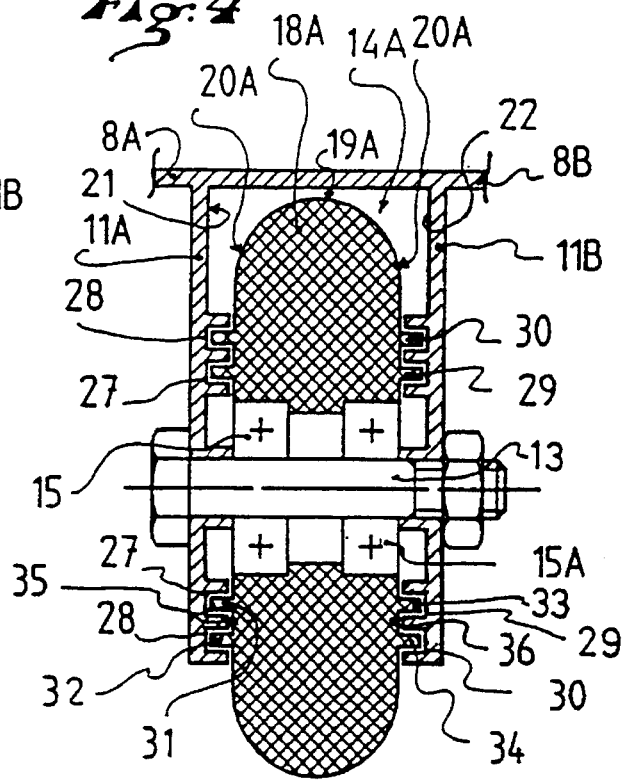
FIG. 4 is a view in diametric section of a skate wheel, in large scale, according to a second embodiment of the invention.

The second exemplary embodiment shown in FIG. 4 differs essentially from the preceding example in that the sealing means of the bearings 15, 15A of the wheel 14A are composed of two annular grooves 27, 28 and 29, 30 arranged respectively on the fork joints 11A, 11B concentric to the axle 13.

The grooves 27, 28 and 29, 30 cooperate by fitting easily into the corresponding annular projections 31, 32 and 33, 34, which are of the same material as the flanks 20A of the envelope 18A, defining between them a peripheral baffle 35, 36 which impedes the path of outside elements toward the bearings 15, 15A.

This solution has the advantage of preventing any friction between the sealing means and thus avoiding wear and tear.

Figure 5:
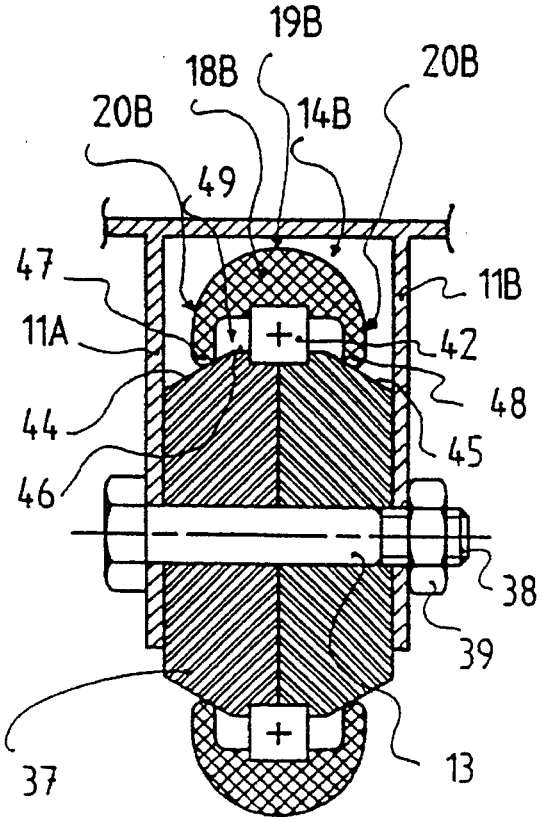
FIG. 5 is a view in diametric section of a skate wheel, in large scale, according to a third embodiment of the invention.

The third exemplary embodiment represented in FIG. 5 differs essentially from the preceding examples in that the wheel 14B consists of a hub 37, fixed solidly to the axle 13 and the fork joints 11A, 11B, by means of a fastening lug system 38, 39 of the axle 13. A single bearing 42, which is larger in diameter than bearings 15, 15A cited previously, is axially mounted on the periphery of the hub 37.

In this case, the sealing means 47, 48 of the bearing 42 are respectively positioned on each side of the wheel 14B, between the flanks 20B of its elastic envelope 18B and two inclined surfaces 44 and 45 constituting the sides of an apex 46 of the hub 37.

Here the sealing means 47, 48, as in the example of FIG. 3, are also composed of elastically deformable annular lips, with a height that is sufficient to cause its compression against the surfaces 44 and 45 of the hub 37, thus defining between the hub and the envelope 18B, a sealed chamber 49 in which the bearing 42 is housed.

Figure 6:
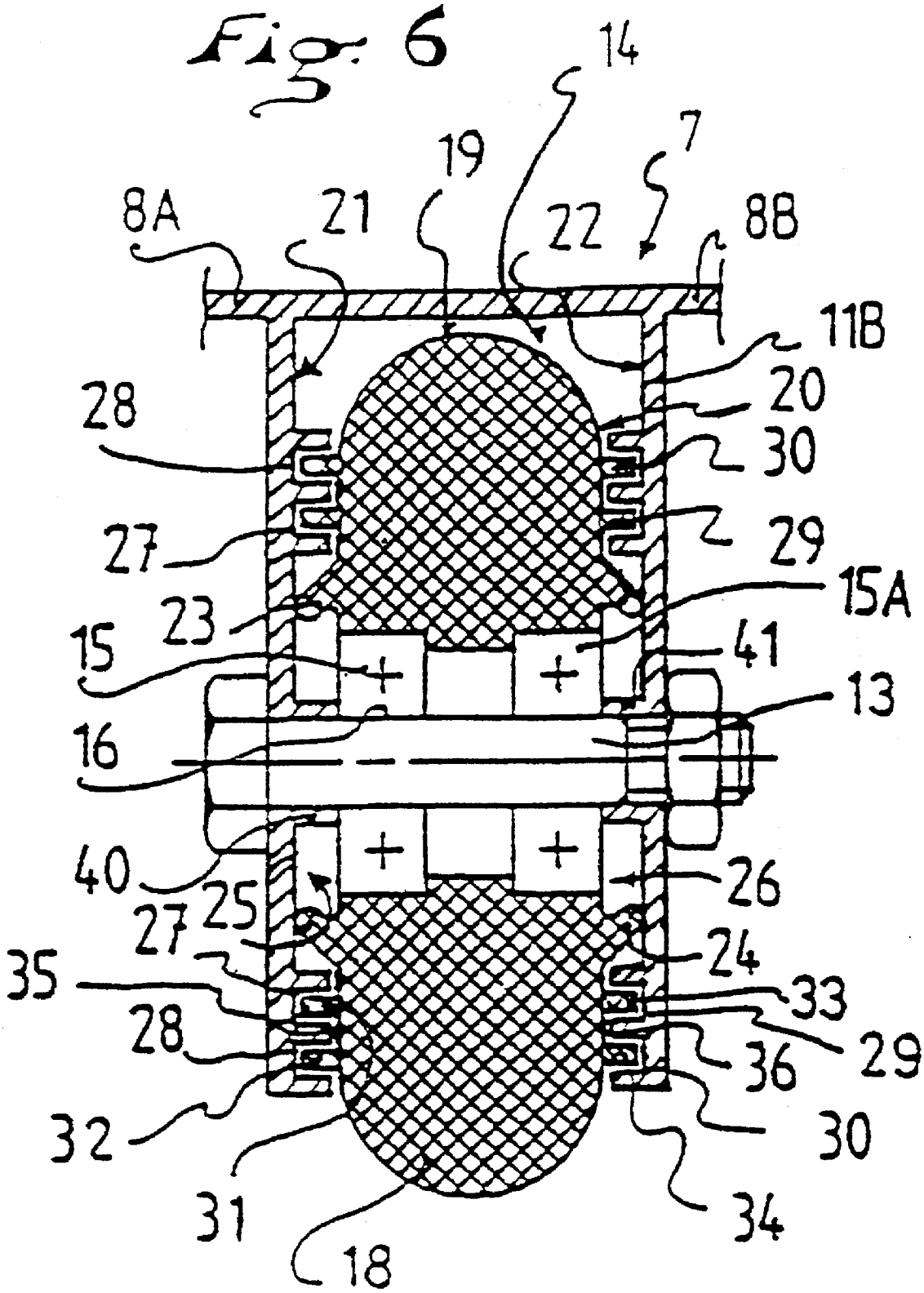
FIG. 6 is a view in diametric section of a skate wheel, in large scale, according to a fourth embodiment of the invention.

In a variant embodiment shown in FIG. 6, the sealing means of the bearings 15, 15A are constituted by a combination of the annular lips 23, 24 that are elastically deformable and made of the same material as the envelope, such as those represented in FIG. 3, and baffles 35, 36 defined by the annular grooves 27, 28 and 29, 30 of the fork joints 11A, 11B and the corresponding projections 31, 32, 33, 34, which are also of the same material as the envelope, such as those represented in FIG. 4.

Whatever the embodiment, the envelope 18, 18A is fabricated of rubber or polyurethane or any other appropriate material.

Finally, although the invention has been described with reference of particular means, materials and embodiments, it is to be understood that the invention is not limited to the particulars disclosed and extends to all equivalents within the scope of the claims.

What is claimed is:

1. A roller skate comprising:

a shoe including a sole;

a chassis extending along a longitudinal axis, said chassis including an upper plate for supporting said sole of said shoe and a lower part extending perpendicularly to said upper plate, said lower part including two lateral flanges, said two lateral flanges forming at least one fork joint;

a plurality of wheels positioned within said fork joint, each of said plurality of wheels being mounted within said fork joint by means of a respective transverse axle extending along a respective transverse axis;

each of said plurality of wheels comprising:

at least one bearing; and an elastic envelope mounted on said bearing for enabling rotation of said elastic envelope about a respective one of said transverse axes, said elastic envelope including a running surface, said running surface extending transversely with respect to said longitudinal axis to form a pair of opposite lateral flanks;

said envelope further including a means for sealing said at least one bearing, said means for sealing being cooperable with a predetermined fixed part of said chassis for sealing said bearing at said fixed part of said chassis;

wherein said means for sealing comprise opposite lateral portions of said envelope extending from respective ones of said lateral flanks of said envelope toward respective inner surfaces of said lateral flanges of said chassis, said respective inner surfaces of said lateral flanges of said chassis constituting said predetermined fixed part of said chassis; and wherein said opposite lateral portions of said envelope comprise opposite annular lips, said annular lips being unitary with said envelope and being elastically deformable, each of said annular lips defining a portion of a closed chamber for enclosing each said bearing.

2. A roller skate according to claim 1, wherein:

each of said annular lips extend toward and engage respective ones of said lateral flanges of said chassis at a non-perpendicular angle with respect to said inner surfaces of said lateral flanges.

3. A roller skate according to claim 1 , wherein:

said means for sealing further comprising means for forming a closed sealed chamber between one of said lateral flanks of said envelope and a respective one of said lateral flanges of said chassis around a respective one of said at least one bearing.

4. A roller skate according of claim 1, wherein:

said envelope is made of rubber.

5. A roller skate according of claim 1, wherein:

said envelope is made of polyurethane.

* * * * *